United States Patent [19]

Jui-Chi et al.

[11] Patent Number: 4,807,654

[45] Date of Patent: Feb. 28, 1989

[54] DISHWASHER

[76] Inventors: Ho Jui-Chi; Wu Shun-chih, both of No. 2, Lane 21, Min-yu Chieh, Lo-dong Jenn, Yi-lan Hsien, Taiwan

[21] Appl. No.: 84,994

[22] Filed: Aug. 13, 1987

[51] Int. Cl.[4] ..... B08B 3/02

[52] U.S. Cl. ..... 134/179; 134/201; 211/41; 239/230; 239/289

[58] Field of Search ..... 134/176, 179, 180, 181, 134/199, 201; 239/230, 289; 211/41, 181

[56] References Cited

U.S. PATENT DOCUMENTS

| | | | |
|---|---|---|---|
| 1,511,661 | 10/1924 | Dantzebecher | 134/176 X |
| 3,236,249 | 2/1966 | Everroad | 134/179 X |
| 3,267,944 | 8/1966 | Meeker et al. | 134/179 |
| 3,606,163 | 9/1971 | Lewis | 239/230 |
| 4,055,304 | 10/1977 | Munson | 239/230 |

*Primary Examiner*—Philip R. Coe
*Attorney, Agent, or Firm*—Ladas & Parry

[57] ABSTRACT

Disclosed herein is a dishwasher having a rack which has a circular protusion formed around its outer periphery so that the rack can be removably suspended from the upper inner periphery of the diswasher tub. A rotary nozzle head assembly is rotatably secured to a central portion of the bottom of the dishwasher tub and connected at its lower end to a water pressure supply. The rotary nozzle head includes a plurality of nozzles for spraying the contents of the dishwasher tub retained in the rack. One of the nozzles in the nozzle head is located to spray against one of the impeller vanes formed on a rotary impact impeller provided at the top of the rotary nozzle head assembly. This causes another impeller vane to impact against an annular supporting frame secured to the top of the rotary nozzle head. In this way, the rotary nozzle head rotates intermittently for effective washing of the contents of the dishwasher tub.

8 Claims, 3 Drawing Sheets

DISHWASHER

BACKGROUND OF THE INVENTION

The present invention relates to a diswasher, and more particularly to a dishwasher which utilizes water pressure impact to rotate a nozzle head in order to wash dishes with spraying water.

Conventional dish washers are mostly designed for washing western type dishes irrespective of whether they utilize a stationary nozzle head or rotary nozzle head. Since Chinese type dishes are different from western type dishes in the configuration, i.e. Chinese type dishes are taller than western type dishes, conventional dish washers are not adapted for washing Chinese type dishes.

In view of the above mentioned disadvantages, the present invention provides a new improved dish washer which is suitable for washing Chinese type dishes.

SUMMARY OF THE INVENTION

According to the present invention there is provided a dish washer comprising a rack which as a circular protrusion formed around the upper outer periphery thereof so that it can be removably suspended from the upper inner periphery of a tub, a rotary nozzle head assembly rotatably secured at the central portion of the bottom of the tub and connected at its lower end to a pressure water supply so as to enable a plurality of nozzles provided on the rotary nozzle head assembly to spray water over the inside and back of the dish retained in the rack as well as to spray water over one of the impeller vanes formed on a rotary impact impeller provided at the top of the rotary nozzle head assembly in order to enable the other impeller vane to impact against an annular supporting frame secured on the top of said rotary nozzle head, by means of the torsion of a torsion spring, and to enable the rotary nozzle head assembly to rotate intermittently, so that all of the dishes received in the rack can be washed in turn.

BRIEF DESCRIPTION OF THE DRAWINGS

An embodiment of the present invention will now be described by way of example with reference to the accompanying drawings in which.

DETAILED DESCRIPTION OF THE PREFERRED EMBODIMENT

Figure 1:
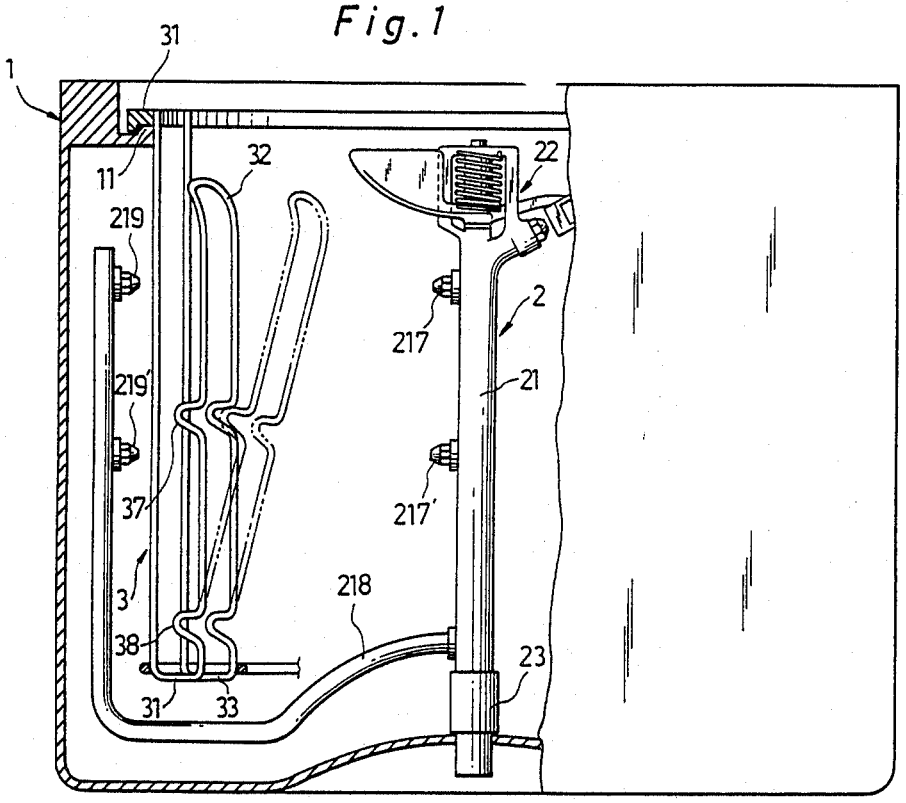
FIG. 1 is a pictorial sectional view of an embodiment of a dishwasher in accordance with the present invention.
Figures 6, 7, 8, 9, 10:
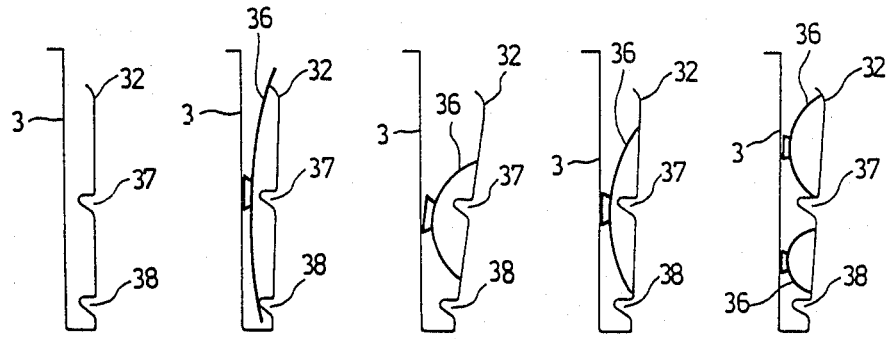
FIGS. 6–10 show various positions of a washing rack in which a dish or dishes is received.

Referring now to FIG. 1, the dishwasher of this invention comprised of a tub (1), a rotary nozzle head assembly (2), and a rack (3), etc. The tub (1) has an L-shaped protrusion (11) facing inwards and formed at the upper inner periphery thereof for engagement with the upper circular protrusion (31) which has an inverted L-shaped cross section formed around the upper outer periphery of the rack (3) in order that the rack (3) can be removably suspended from the upper inner periphery of the tub (1). The rotary nozzle head assembly (2) is rotatably uprightly secured at the central portion of the bottom of the tub (1).

Figures 2, 4:
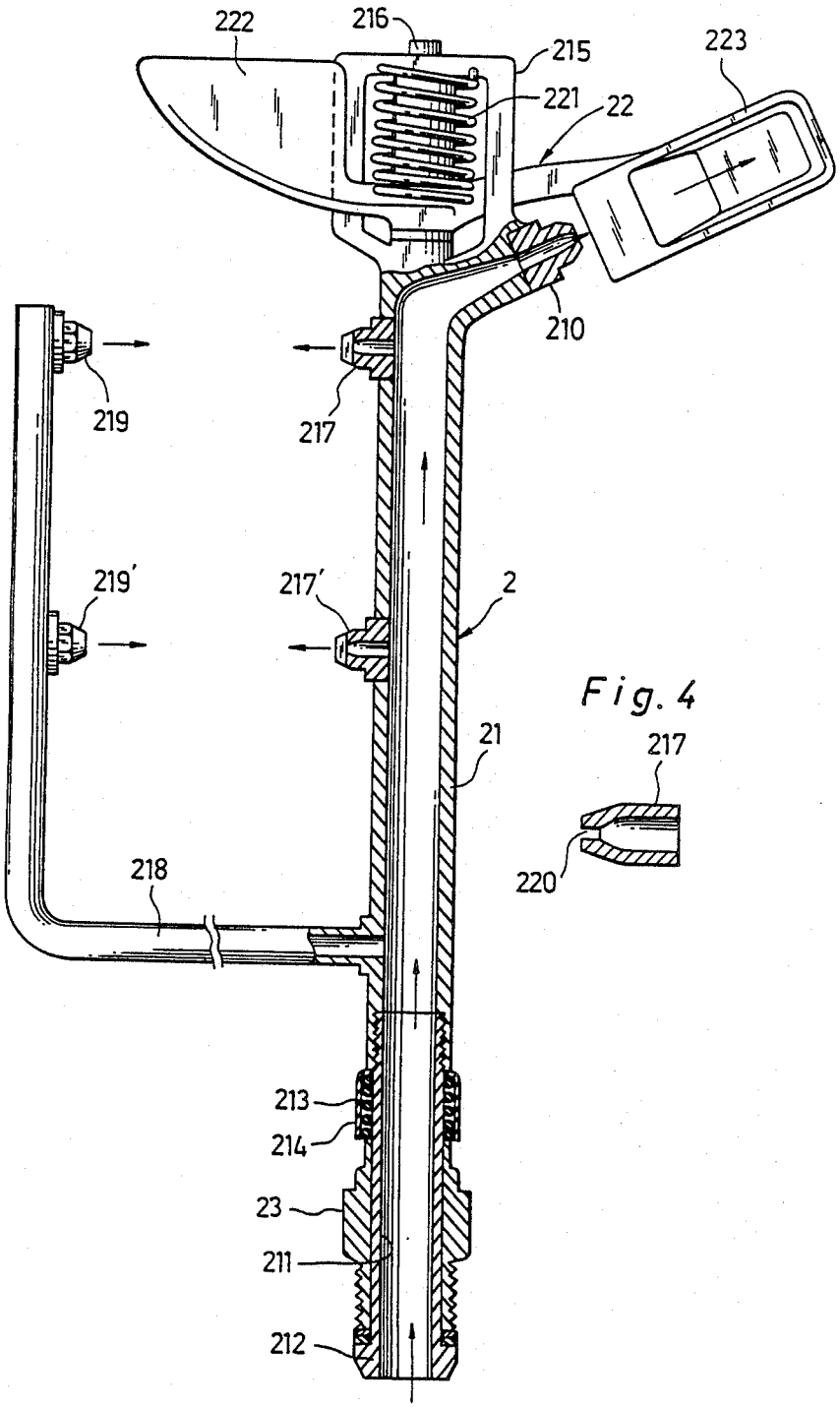
FIG. 2 is a pictorial view of the structure of the rotary nozzle head for a dishwasher in accordance with the present invention.
FIG. 4 is a cross sectional view of the nozzle of the present invention.
Figure 3:
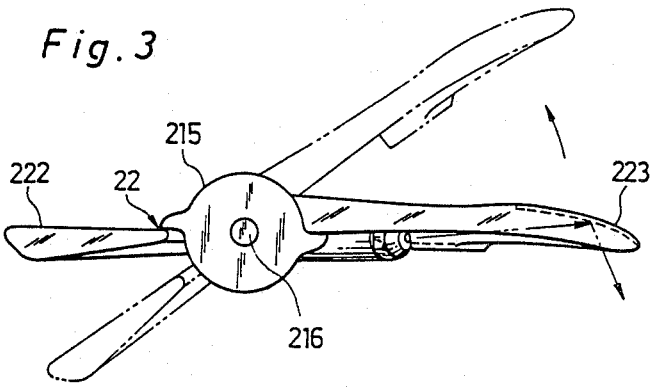
FIG. 3 is a top view of FIG. 2.

As shown in FIG. 2, the rotary nozzle head assembly (2) comprises a water pipe shaft (21), a rotary impact impeller (22), and a stationary base (23). The stationary base (23) is uprightly firmly secured at the central portion of the bottom of the tub (1) by means of screw engagement. The water pipe shaft (21) is formed into a tubular hollow member and connected at its low end to a pressure water supply (not shown), and has a reduced lower end (211) slidably engaged with the stationary base (23) and having an annular enlarged portion (212) formed at the lower most end therof in order to prevent the water pipe shaft (21) from being removed upwards from the stationary base (23). A compression spring (213) is provided between the reduced lower end (211) and the upper end of the stationary base (23) by means of a cylindrical cover (214) for biasing the water pipe shaft (21) upwards to a predetermined position where the annular enlarged portion (212) rests on the stationary base (23). The water pipe shaft (21) is provided with an annular supporting frame (215) at the top end thereof, which is provided with a central shaft (216) for rotatably engaging with the rotary impact impeller (22). A torsion spring (221) is provided between the upper portion of the annular supporting frame (215) and the rotary impact impeller (22) for biasing the left impeller vane (222) against the left portion of the annular supporting frame (215). The left impeller vane (222) is formed in a triangle while the right impeller vane (223) is formed in a concave arc. They are integrally formed. The water pipe shaft (21) is further provided with a pair of upper and lower nozzles (217) and (217') on the upper left side wall thereof which are spaced apart and arranged in alignment one with the other for spraying over the inside of the dish with water.

A branch pipe (218) is provided on the lower left side wall of the water pipe shaft (21), and formed in an L-shape and communicates with the water pipe shaft (21). The branch pipe (218) is provided with a pair of upper and lower nozzles (219) and (219') on the upper right side wall thereof, and spaced apart, and arranged in alignment one with the other, and they are opposite to the above-mentioned pair of nozzles (217) and (217') for spraying over the back of a dish with water. The water pipe shaft (21) is further provided with a nozzle (210) on the upper right side wall thereof, which is opposite to the concave arc surface of the right impeller vane (223) for spraying over the same with water coming from the water pipe shaft, in order that the right impeller vane (223) can be angularly moved to a desired position where its torque is equal to that of the torsion spring (221), and the right impeller vane (223) will be returned to its original position by means of the torsion in the torsion spring (221) for enabling the left impeller vane (222) to impact against the left portion of the annular supporting frame (215), and producing a torque which is greater than the friction force produced between the annular enlarged portion (212) and the stationary base (23), in order to enable the whole rotary nozzle head assembly (2) to rotate until said torque is equal to said friction force. This will result in the intermittent rotational movement of the rotary nozzle head assembly (2) if the above mentioned impact cycle repeats, in order that all of the dishes which are received in the rack (3) can be washed in turn.

As shown in FIG. 4, the nozzles (217), (217'), (219) and (219') each has a narrow rectangular slot-shaped orifice (220) provided at the front end thereof, which communicates with an inner conical hole, in order to obtain a wider water curtain for carrying out an effective washing of the dishes.

Figure 5:
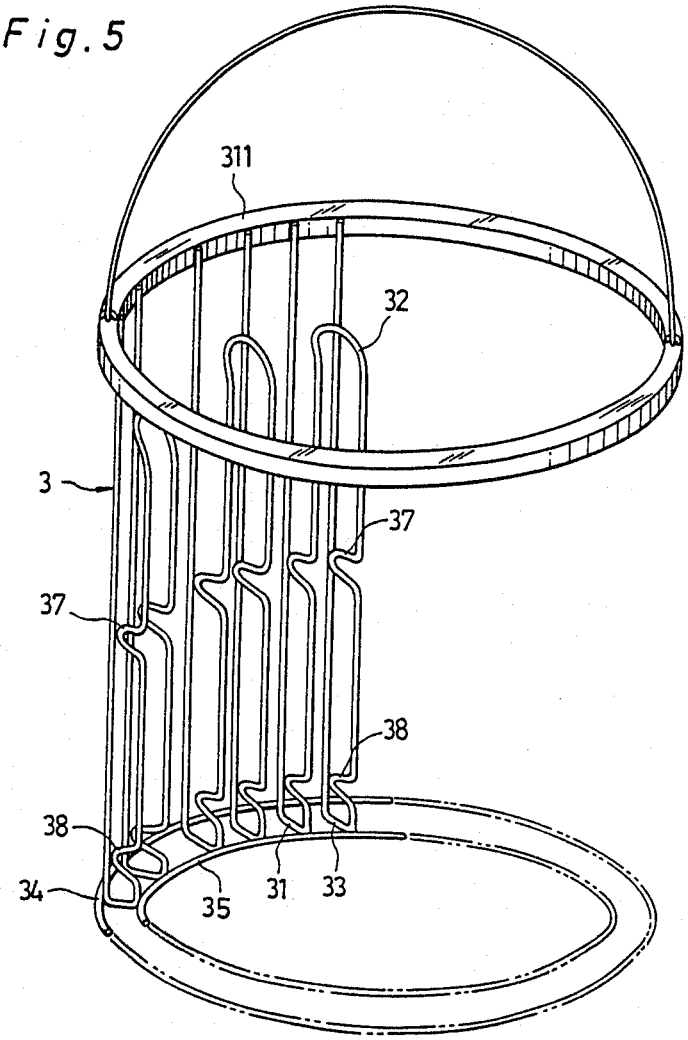
FIG. 5 is a pictorial sectional view of a washing rack according to the present invention.

Referring now to FIG. 5, the rack (3) comprises a plurality of spaced bow-shaped retainers which are made of a steel wire which is bent into continuous three-U portions (31), (32), and (33). U portions (31) and (32) are mounted on the two base steel wires (34) and (35) by welding while U-32 is in the free state and can be expanded inwards to a certain extent for retaining dish (36) as shown in FIGS. 6–10. The two ends of the above first mentioned steel wire are mounted on the inner periphery of the upper circular protrusion 311 which has an inverted L-shaped cross section. U-32 has two bent portions (37) and (38) formed at the intermediate and lower portions thereof for enhancing its elasticity and for firmly retaining dishes.

We claim:

1. A dishwasher for washing dishes and connectable to a pressurized water supply, said dishwasher comprising:

a tub having an upper inner periphery and a bottom opposite said upper inner periphery, said tub bottom defining a central portion therein;

a rotary nozzle head having a top and a bottom opposite said top, said nozzle head bottom being connected to said central portion of said tub and said pressurized water supply;

a rack having an upper outer periphery and a circular protrusion formed around said upper outer periphery so that said rack can be removably suspended from said upper inner periphery of said tub;

a rotary impact impeller comprised of impeller vanes, said impact impeller being located at said top of said rotary nozzle head;

a torsion spring associated with said impeller vanes;

an annular support frame associated with said top of said nozzle head; and a plurality of nozzles associated with said nozzle head and communicating through said nozzle head with said pressurized water supply, said nozzles being operable to spray water onto dishes held in said dishwasher and onto at least one of said impeller vanes so that another of said impeller vanes impacts against said annular support frame such that said rotary nozzle head can rotate intermittently in said dishwasher.

2. The dishwasher of claim 1 wherein said rotary nozzle head is comprised of a first tubular pipe having upper and lower ends and associated with said annular support frame and a second branch pipe connected to said first tubular pipe, said nozzles being located on both said first tubular and second branch pipes such that at least some of said nozzles carried on said second branch pipe lie generally opposite of said nozzles carried on said first tubular pipe such that said dishes are sprayed from opposite sides by said nozzles.

3. The dishwasher of claim 2 further comprising a central shaft associated with said annular support frame and rotatably engaging said rotary impact impeller.

4. The dishwasher of claim 3 wherein one of said impeller vanes has a concave arc-like surface.

5. The dishwasher of claim 4 wherein siad rotary nozzle head comprises:

a stationary base having an upper end and a lower end opposite said upper end, said lower base end being firmly secured to said central portion of said tub bottom, said first tubular pipe having a reduced portion which is slidably held within said stationary base and an enlarged portion near said lower end of said first tubular pipe to prevent removal of said tubular pipe from said stationary base; and a compression spring provided on said reduced portion of said first tubular pipe and generally adjacent said upper end of said stationary base such that said annular enlarged portion rests against said lower end of said stationary base, said upper end of said first tubular pipe being connected to said annular supporting frame, said torsion spring being provided between said annular supporting frame and said rotary impact impeller.

6. The dishwasher of claim 5 wherein at least one of said nozzles provided on said first tubular pipe is located opposite to said concave arc of said at least one impeller vane for spraying said concave arc in order that said arced impeller vane can be angularly moved to a desired position where its torque is equal to that of said torsion spring, said arced impeller vane being returned to its original position by means of said torsion spring and impact against said annular supporting frame for producing a torque greater than the friction force produced between said annular enlarged portion and said stationary base in order to enable said rotary nozzle head to rotate until said torque is equal to said friction force.

7. The dishwasher as claimed in claim 6 wherein each of said nozzles defines a narrow rectangular slot-shaped orifice and an inner conical area which communicates with said slot-shaped orifice.

8. The dishwasher as claimed in claim 7 wherein said rack is comprised of a plurality of spaced, bow-spaced retainers secured to said upper circular protrusion; and two circular base steel wires located opposite of said upper circular protrusion, said bow-shaped retainers being bent into a first, a second, and a third U-portion, the first and third U-portions being mounted on said two steel wires, said second U-portion standing freely and being centrally expandable in said tub to enable retention of differing dish sizes, said second U-shaped wire defining bent portions in its length for enhancing its elasticity and its ability to retain said dishes.

* * * * *